US006737019B2

(12) United States Patent
Fukuzumi et al.

(10) Patent No.: US 6,737,019 B2
(45) Date of Patent: May 18, 2004

(54) SULFUR-CONTAINING FREE-CUTTING STEEL

(75) Inventors: Tatsuo Fukuzumi, Utsunomiya (JP); Motoki Watanabe, Utsunomiya (JP); Tsuneo Yoshimura, Tokyo (JP)

(73) Assignees: Mitsubishi Steel Mfg. Co., Ltd., Tokyo (JP); Yoshimura Technical Office Inc., Tokyo (JP)

( * ) Notice: Subject to any disclaimer, the term of this patent is extended or adjusted under 35 U.S.C. 154(b) by 3 days.

(21) Appl. No.: 10/142,091

(22) Filed: May 9, 2002

(65) Prior Publication Data

US 2003/0175144 A1 Sep. 18, 2003

(30) Foreign Application Priority Data

Mar. 12, 2002 (JP) ..... 2002-067164

(51) Int. Cl.[7] ..... C22C 38/60
(52) U.S. Cl. ..... 420/87
(58) Field of Search ..... 420/87

(56) References Cited

U.S. PATENT DOCUMENTS 3,902,898 A 9/1975 Denhard, Jr. et al.

FOREIGN PATENT DOCUMENTS

| | | |
|---|---|---|
| EP | 0 496 350 A1 | 7/1992 |
| GB | 815 095 | 6/1959 |
| GB | 2 191 506 | 12/1987 |
| JP | 62-270752 | 11/1987 |
| JP | 63-111157 | 5/1988 |
| JP | 3-56638 | 3/1991 |
| JP | 11-293391 | 10/1999 |
| JP | 2000-160284 | 6/2000 |
| JP | 2000-319753 | 11/2000 |

*Primary Examiner*—Deborah Yee
(74) *Attorney, Agent, or Firm*—Flynn, Thiel, Boutell & Tanis, P.C.

(57) ABSTRACT

A high-sulfur free-cutting steel which has a chemical composition containing, in mass %, 0.03 to 0.20% C, 0.35% or less Si (including 0%), 0.30 to 2.00% Mn, 0.01 to 0.15% P, 0.35 to 0.65% S 0.0100 to 0.0250% O, 0.020% or less N, 0.005% or less Al (including 0%), 0.02 to 0.20% Nb, and further containing 0.05 to 0.50% V or 0.02 to 0.20% Ti, or both, with the remainder consisting of Fe and unavoidable impurities, wherein sulfide type inclusions, as the principal nonmetallic inclusions contained in the steel, have a mean size of 50 $\mu m^2$ or less and are present at the rate of 500 to 1000 inclusions per $mm^2$ in the cross section of the steel. The sulfur-containing free-cutting steel has a good machinability comparable or superior to that of free-cutting steels containing heavy metals which have a deleterious effect on the environment, without requiring the addition of such undesirable heavy metals.

10 Claims, 1 Drawing Sheet

SULFUR-CONTAINING FREE-CUTTING STEEL

BACKGROUND OF THE INVENTION

1. Field of the Invention

The present invention relates to a sulfur-containing free-cutting steel used as a material in parts that do not require a great deal of strength, in which SUM steels stipulated by JIS and SAE 11xx and SAE 12xx steels stipulated by SAE standards are utilized.

2. Description of the Related Art

S-containing free-cutting steels, such as JIS SUM steels, SAE 11xx steels or SAE 12xx steels are drawn after being rolled, and are used in automatic machining as polished rod steels. Sulfur-containing free-cutting steels in which S is added to the steel in order to improve the machinability of the steel by means of high-speed steel tools have been used as conventional free-cutting steels of this type.

The machinability of such sulfur-containing free-cutting steels improve with an increase in the S content; on the other hand, however, defective products suffering from cracking and the like are generated in large quantities because of red-shortness during hot working such as rolling, forging and the like. This is caused by the precipitation of low-melting-point FeS in the grain boundaries due to the high sulfur content. Furthermore, in the case of high-S steels, the ductility and reduction of area in the lateral direction with respect to the direction of rolling drop, so that trouble occurs during drawing. Accordingly, 0.35% has generally been set as the upper limit of the S content, and at the very most, this content has been limited to 0.40%.

Furthermore, composite free-cutting steels which contain heavy metals such as Pb, Te, Bi or the like in addition to S have been developed as free-cutting steels that have superior machinability. In recent years, however, environmental problems have been viewed with increasing seriousness, so that there has been a demand for the development of free-cutting steels which do not use such heavy metals that have a detrimental effect on the environment, and which have a good machinability comparable to or superior to that of free-cutting steels that contain heavy metals.

SUMMARY OF THE INVENTION

It is an object of the present invention to provide a sulfur-containing free-cutting steel with superior machinability, which does not achieve improved machinability by the addition of heavy metals that have a detrimental effect on the environment, and which does not cause problems during manufacture, especially during hot working or cold drawing.

The present invention is a high-sulfur free-cutting steel which has a chemical composition comprising, in mass %, 0.03 to 0.20% C, 0.35% or less Si (including 0%), 0.30 to 2.00% Mn, 0.01 to 0.15% P, 0.35 to 0.65% S, 0.0100 to 0.0250% O, 0.020% or less N, 0.005% or less Al (including 0%), 0.02 to 0.20% Nb, and further containing 0.05 to 0.50% V or 0.02 to 0.20% Ti, or both, with the remainder consisting of Fe and unavoidable impurities, wherein sulfide type inclusions as principal nonmetallic inclusions contained in the steel have a mean size of 50 $\mu m^2$ or less and are present at the rate of 500 to 1000 inclusions per $mm^2$ in the cross section of the steel.

First of all, in the present invention, the S content is a large S content that exceeds the 0.35% conventionally considered, to be the upper limit. In order to prevent the occurrence of deleterious effects such as hot brittleness and the like caused by such a large S content, the precipitation of FeS is prevented by including a large quantity of Mn, so that only MnS type sulfides are precipitated.

Furthermore, it was discovered that good free-cutting properties can be obtained by increasing the frequency of contact between these MnS type sulfides and the cutting tool.

Accordingly, although the precipitation of MnS type sulfides into the steel begins from the time of solidification of the molten steel, it was discovered that the inclusions can be made finer by utilizing TiN, which precipitates into the molten steel at the temperature of the molten steel, and NbN and VN, which precipitate into the γ-iron during the solidification process, as nuclei for the precipitation of MnS type sulfides, so that the number of precipitated inclusions is increased; furthermore, it was discovered that a uniform dispersion of these inclusions can be obtained.

Accordingly, in order to eliminate the presence of α-type $Al_2O_3$ inclusions that shorten the tool life, the joint deoxidation of Si—Mn was used as a base for deoxidation of the molten steel instead of using Al. Furthermore, hard silicate type oxide inclusions were minimized by lowering the Si content to 0.35% or less, and V or Ti, or both, were added in addition to Nb as deoxidation assistants in order to maintain the oxygen level in the molten steel following deoxidation at a stable 0.01 to 0.025%. It was discovered that MnS type sulfides can be finely and uniformly dispersed and precipitated by utilizing the residues of these elements in the molten steel as nuclei for the precipitation of such MnS type sulfides. The residues referred to here also naturally include oxides of Nb and the like; it appears entirely possible that these substances also serve as bonding agents in the form of composite inclusions and nuclei for the precipitation of MnS type inclusions.

Furthermore, it was discovered that as a result of the oxygen level being maintained at 0.01 to 0.0250%, the hardness of the precipitated MnS type sulfides also drops, thus prolonging the tool life and reducing the aspect ratio of MnS inclusion (ratio of the length to the diameter of the MnS inclusion), so that the chip breakability is improved.

The three discoveries mentioned above form the basis of the present invention. A sulfur-containing free-cutting steel was developed which has workability well comparable to or superior to that of steels containing heavy metals such as Pb, Bi, Te and the like, without requiring the addition of such heavy metals.

DESCRIPTION OF THE PREFERRED EMBODIMENTS

Figure 1:
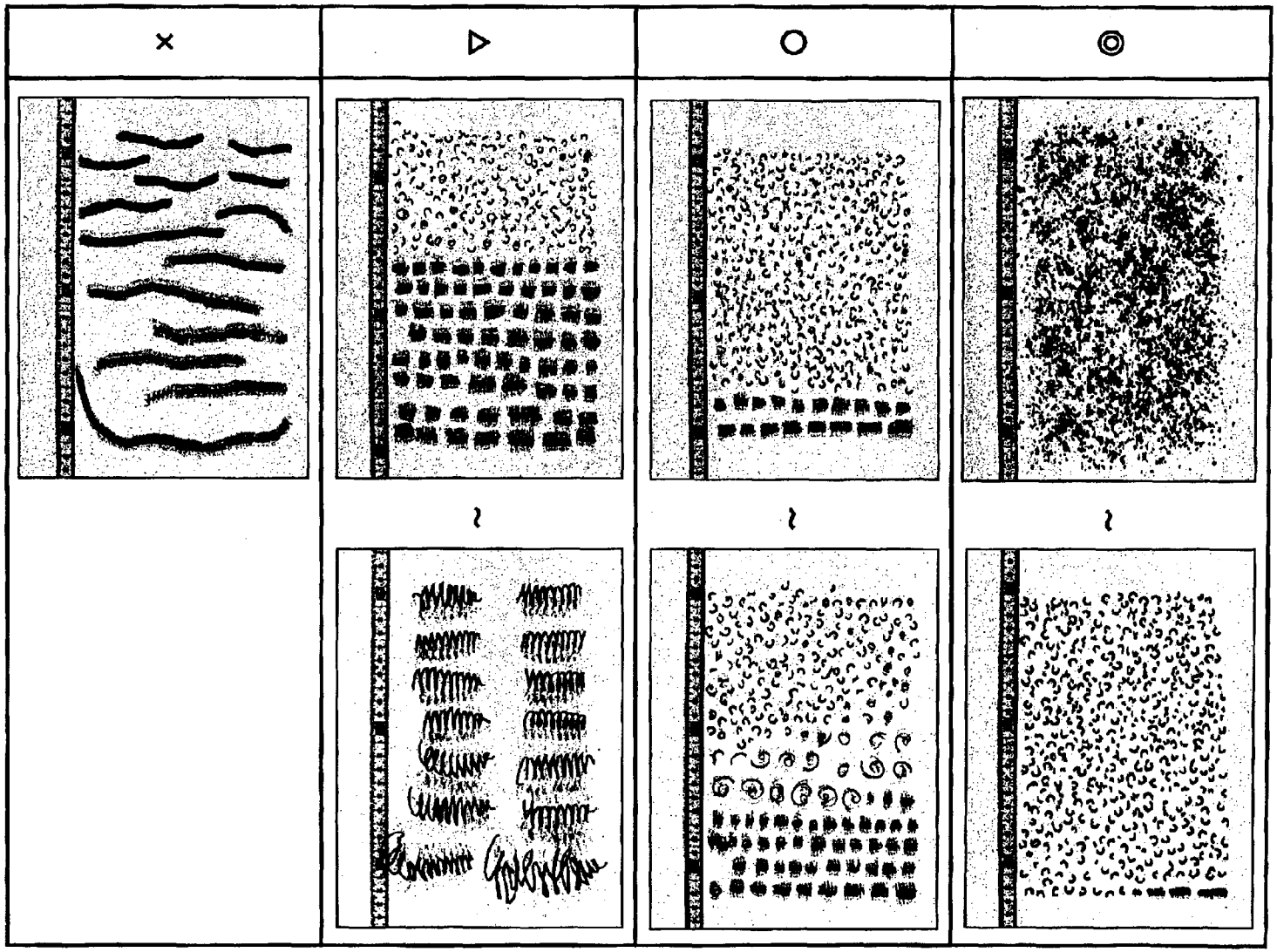
FIG. 1 shows photographs illustrating the evaluation criteria for the chip breakability in cases where test samples of the inventive steels and comparative steels were machined using a lathe.

Below, the reasons for limiting the contents of the chemical components of the sulfur-containing free-cutting steel of the present invention will be described.

C: 0.03 to 0.20%

In cases where the C content is large, cracking occurs during drawing; accordingly, the upper limit is set at 0.20%. On the other hand, in cases where the C content is low, there is an excessive drop in strength; accordingly, the lower limit of the C content is set at 0.03%.

Si: 0.35% or Less (Including 0%)

Si is used as a joint deoxidizing agent with Mn. However, in cases where an excessive amount of Si is added, the hardness of the steel is increased, and the silicon oxides that constitute deoxidation products are hard, so that there is a deterioration in the tool life. Accordingly, the upper limit was set at 0.35%. Preferably, the amount added is 0.10% or less, and joint deoxidation with Mn is performed. In order to reliably maintain the oxygen content at 0.01 to 0.025% in the molten steel prior to casting, Nb (described later) and either V or Ti, or both, are used as deoxidation assistants.

Mn: 0.30 to 2.00%

In order to prevent the precipitation of low-melting-point FeS at grain boundaries, which causes hot brittleness, Mn is added so that stable MnS is precipitated. In order to obtain this action effectively, it is necessary to add Mn in the range of 0.30 to 2.00%.

P: 0.01 to 0.15%

P is added in the range of 0.01 to 0.15% in order to improve the finished cut surface of the steel. The desired object cannot be sufficiently achieved outside this range.

S: 0.35 to 0.65%

It is known that the machinability improves with an increase in the S content, and that the hot workability deteriorates as the S content increases. Accordingly, the upper limit on the S content has conventionally been set at 0.35%. If joint deoxidation of Si—Mn is performed using the Nb and V and/or Ti of the present invention as deoxidation assistants, there is no loss of hot workability even if the upper limit on the S content is set at 0.65%.

O (Oxygen): 0.0100 to 0.0250%

The oxygen content in the final stage of decarburizing refining of the molten steel is approximately 600 to 1200 ppm. However, in the case of such oxygen levels, continuous casting is impossible by a rimming action; accordingly, forcible deoxidation by means of Al is usually performed. However, if deoxidation by means of Al is performed, hard $\alpha$-type $Al_2O_3$ is produced as a deoxidation product, and this causes a shortening of the tool life during cutting. Accordingly, deoxidation by means of Al is not deliberately performed in the present invention. Furthermore, the amount of Si added is preferably kept to 0.10% or less, and deoxidation is performed using Nb or V and a small amount of Ti which have a deoxidizing power comparable to that of Mn as assistants in order to maintain the oxygen content stably in the range of approximately 250 ppm, which is the joint deoxidation limit for Si—Mn, to 100 ppm.

N: 0.020% or Less

A special feature of the present invention is that fine NbN, VN and TiN are precipitated in the $\gamma$-iron as precipitation nuclei, and then MnS is precipitated around these nuclei, in order to achieve substantially uniform dispersion and precipitation of Mn sulfides in the steel. Accordingly, a maximum N content of 0.020% is required.

Al: 0.005% or Less (Including 0%)

As was described above, forcible deoxidation by means of Al is not intentionally performed. However, Al is contained in slight amounts in the FeSi, FeNb, FeV and FeTi used, so that trace amounts of Al remain in the steel when these compounds are added to the molten steel. Accordingly, the maximum amount of Al is limited to 0.005%.

Nb: 0.02 to 0.20%

As was described above, one object of the present invention is to improve the hot and cold workability and machinability by using the production of MnS to suppress the precipitation of FeS. Nb used as a deoxidation assistant precipitates deoxidation products, nitrides and carbonitrides in the $\gamma$-iron during the solidification of the molten steel, and these compounds act effectively as nuclei for the precipitation of MnS, so that the sulfide inclusions are made finer and the number of inclusions precipitated is increased with a uniform dispersion of these inclusions, thus improving the hot and cold workability and machinability. If the amount of Nb added is less than 0.02% or greater than 0.20%, this effect is insufficient.

V: 0.05 to 0.50% and/or Ti: 0.02 to 0.20%

As was described above, these elements play an auxiliary role in the joint deoxidation of Si—Mn. Nitrides of V that precipitate in the $\gamma$-iron, and TiN that precipitates in the molten steel, act effectively to maintain the amount of oxygen in the molten steel stably in the range of 100 to 250 ppm, to maintain the shape of the MnS following solidification of the molten steel as a shape that is close to spherical, which has a favorable effect on the machinability, and, like the above-mentioned Nb, to cause substantially uniform dispersion of the precipitated MnS throughout the steel. If the amounts used are less than the respective lower limits or greater than the respective upper limits, the effect is insufficient.

The steel of the present invention has the above prescribed composition and includes sulfide type inclusions as the main nonmetallic inclusions wherein the steel the sulfide type inclusions have a mean size of 50 $\mu m^2$ or less and are present at the rate of 500 to 1000 inclusions per $mm^2$ in a cross section of the steel. Due to these numerical limitations, the steel of the present invention has superior machinability coupled with good workability. If the above mean size and number are outside the above ranges, sufficient machinability and workability cannot be attained.

EXAMPLES AND COMPARATIVE EXAMPLES

Steels with the compositions shown in Table 1 were manufactured using a high-frequency induction furnace, and were cast into 20-kg steel ingots.

TABLE 1

(Mass %)

| | C | Si | Mn | P | S | Al | Ti | Nb | V | O | N | Pb |
|---|---|---|---|---|---|---|---|---|---|---|---|---|
| 1 | 0.03 | 0.10 | 1.15 | 0.035 | 0.498 | 0.001 | 0.195 | 0.021 | 0.10 | 0.0132 | 0.0198 | — |
| 2 | 0.08 | 0.02 | 1.14 | 0.044 | 0.487 | — | — | 0.026 | 0.05 | 0.0111 | 0.0075 | — |
| 3 | 0.09 | 0.02 | 1.20 | 0.012 | 0.535 | 0.001 | 0.020 | 0.028 | — | 0.0128 | 0.0076 | — |
| 4 | 0.07 | 0.01 | 0.83 | 0.051 | 0.354 | 0.002 | — | 0.022 | — | 0.0245 | 0.0101 | — |
| 5 | 0.12 | 0.07 | 1.06 | 0.070 | 0.511 | — | 0.024 | 0.020 | — | 0.0140 | 0.0092 | — |
| 6 | 0.11 | 0.07 | 1.54 | 0.056 | 0.417 | — | — | 0.035 | 0.16 | 0.0186 | 0.0100 | — |

TABLE 1-continued

| | (Mass %) | | | | | | | | | | | |
|---|---|---|---|---|---|---|---|---|---|---|---|---|
| | C | Si | Mn | P | S | Al | Ti | Nb | V | O | N | Pb |
| 7 | 0.19 | 0 | 1.23 | 0.042 | 0.508 | — | — | 0.084 | — | 0.0243 | 0.0073 | — |
| 8 | 0.08 | 0.02 | 1.18 | 0.023 | 0.486 | 0.004 | — | 0.199 | — | 0.0226 | 0.0090 | — |
| 9 | 0.05 | 0.01 | 1.98 | 0.052 | 0.488 | 0.002 | 0.081 | 0.033 | 0.48 | 0.0210 | 0.0079 | — |
| 10 | 0.14 | 0.03 | 1.06 | 0.048 | 0.475 | 0.001 | — | 0.025 | — | 0.0198 | 0.0045 | — |
| 11 | 0.09 | 0.12 | 1.37 | 0.046 | 0.376 | 0.021 | — | — | — | 0.0083 | 0.0090 | 0.23 |
| 12 | 0.08 | 0.16 | 1.12 | 0.048 | 0.380 | 0.006 | — | — | — | 0.0106 | 0.0079 | 0.26 |
| 13 | 0.09 | 0.11 | 1.21 | 0.052 | 0.325 | — | — | — | — | 0.0174 | 0.0085 | 0.22 |
| 14 | 0.10 | 0.12 | 1.11 | 0.056 | 0.331 | — | — | — | — | 0.0156 | 0.0083 | 0.32 |

Nos. 1–10: Steels of the present Invention
Nos. 11–14: Comparative Steels

Test samples were produced by forge-drawing the above-mentioned ingots into round bars with a diameter of 40 mm, and these samples were tested for machinability using a lathe. Testing conditions were as follows.

Sample heat treatment: normalizing
Tool: carbide tipped tool SNGA 120404 (manufactured by Mitsubishi Materials Corp.)
Cutting speed: 100 m/min
Depth of cut: 1 mm
Feed: 0.02, 0.05, 0.10, 0.15, 0.20 mm/rev
Cutting oil: none
Item evaluated: chip breakability of each tested sample The evaluation of the chip breakability when the test samples were machined using a lathe, as well as the mean size of the sulfide type inclusions in cross section and the number of inclusions per $mm^2$ of test area, are shown in Table 2.

TABLE 2

| | Chip breakability of tested sample | | | | | | |
|---|---|---|---|---|---|---|---|
| | Feed 0.02 (mm/rev) | Feed 0.05 (mm/rev) | Feed 0.10 (mm/rev) | Feed 0.15 (mm/rev) | Feed 0.20 (mm/rev) | Mean size ($\mu m^2$) | Number |
| 1 | ◎ | ◎ | ◎ | ◎ | ◎ | 26 | 853 |
| 2 | ◎ | ◎ | ◎ | ◎ | ◎ | 29 | 612 |
| 3 | ◎ | ◎ | ◎ | ◎ | ◎ | 33 | 654 |
| 4 | ◎ | ◎ | ◎ | ◎ | ◎ | 44 | 988 |
| 5 | ◎ | ◎ | ◎ | ◎ | ◎ | 37 | 673 |
| 6 | ◎ | ◎ | ◎ | ◎ | ◎ | 30 | 721 |
| 7 | ◎ | ◎ | ◎ | ◎ | ◎ | 32 | 815 |
| 8 | ◎ | ◎ | ◎ | ◎ | ◎ | 28 | 784 |
| 9 | ◎ | ◎ | ◎ | ◎ | ◎ | 23 | 713 |
| 10 | ◎ | ◎ | ◎ | ◎ | ◎ | 42 | 580 |
| 11 | x | Δ | Δ | ○ | ◎ | 62 | 353 |
| 12 | ◎ | Δ | ○ | Δ | Δ | 70 | 379 |
| 13 | ◎ | Δ | Δ | ○ | ◎ | 58 | 430 |
| 14 | ◎ | Δ | ○ | ○ | ○ | 75 | 418 |

Nos. 1–10: Steels of the Present Invention
Nos. 11–14: Comparative Steels

As it is cleared from these results, the free-cutting steel of the present invention is comparable to or even superior to conventional free-cutting steels that contain heavy metals which are harmful to the environment, but does not contain such harmful heavy metals. The machinability was evaluated by comparison of the chip breakability of each tested sample. In regard to the evaluation criteria used to evaluate the relative superiority of the test results for chip breakability, the test results were evaluated using the four grades of ◎, ○, Δ and x shown in FIG. 1.

As is shown in Table 2, the present invention received a grade of ◎, i.e., the best grade, at all of the respective feed rates of the lathe.

Furthermore, the properties (mean size, number) of the sulfides in the steel were investigated by the following method. Samples for microscopic observation were cut from a location extending to ⅙ of the diameter (D/6) in the lateral cross section with respect to the forge-drawing direction, i. e., from the cross-sectional surface skin, of the round bars with a diameter D of 40 mm which is the extension of the test samples used for the machinability, and the mean size and number of the sulfide type inclusions were counted using a 400-power optical microscope. Observation of the inclusions in the cross section allows the size and distribution of the inclusions to be easily ascertained.

The present invention provides a sulfur-containing free-cutting steel with machinability comparable to or even superior to that obtained in cases where heavy metals which have a deleterious effect on the environment are added, without resorting to the addition of such undesirable heavy metals in order to achieve such an improvement in the machinability, and without causing an problems in terms of manufacture.

What is claimed is:

1. A high-sulfur free-cutting steel which has a chemical composition consisting essentially of, in mass %, 0.03 to 0.20% C, 0.35% or less Si, 0.30 to 2.00% Mn, 0.01 to 0.15% P, 0.35 to 0.65% S, 0.0100 to 0.0253% O, 0.020% or less N, 0.005% or less Al, 0.02 to 0.20% Nb, and at least one of 0.05 to 0.50% V and 0.02 to 0.20% Ti, with the remainder consisting of Fe and unavoidable impurities, wherein sulfide type inclusions as principal nonmetallic inclusions contained in the steel have a mean size of 50 $\mu m^2$ or less and are present at the rate of 500 to 1000 inclusions per $mm^2$ in a cross section of the steel.

2. A high-sulfur free-cutting steel which has a chemical composition consisting of, in mass %, 0.03 to 0.20% C, 0.35% or less Si, 0.30 to 2.00% Mn, 0.01 to 0.15% P, 0.35 to 0.65% S, 0.0100 to 0.0250% O, 0.020% or less N, 0.005% or less Al, 0.02 to 0.20% Nb, and at least one of 0.05 to 0.50% V and 0.02 to 0.20% Ti, with the remainder consisting of Fe and unavoidable impurities, wherein sulfide type inclusions as principal nonmetallic inclusions contained in the steel have a mean size of 50 $\mu m^2$ or less and are present at the rate of 500 to 1000 inclusions per $mm^2$ in a cross section of the steel.

3. The high-sulfur free-cutting steel of claim 1, wherein 0.05 to 0.50% V is contained therein.

4. The high-sulfur free-cutting steel of claim 2, wherein 0.05 to 0.50% V is contained therein.

5. The high-sulfur free-cutting steel of claim 1, wherein 0.02 to 0.20% Ti is contained therein.

6. The high-sulfur free-cutting steel of claim 2, wherein 0.02 to 0.20% Ti is contained therein.

7. The high-sulfur free-cutting steel of claim 1, wherein both 0.05 to 0.50% V and 0.02 to 0.20% Ti are contained therein.

8. The high-sulfur free-cutting steel of claim 2, wherein both 0.05 to 0.50% V and 0.02 to 0.20% Ti are contained therein.

9. The high-sulfur free-cutting steel of claim 1, wherein 0.51 to 0.65% S is contained therein.

10. The high-sulfur free-cutting steel of claim 2, wherein 0.51 to 0.65% S is contained therein.

* * * * *